US006331240B1

(12) United States Patent
Tsunoda et al.

(10) Patent No.: US 6,331,240 B1
(45) Date of Patent: Dec. 18, 2001

(54) TIN-INDIUM ALLOY ELECTROPLATING SOLUTION

(76) Inventors: Kyoko Tsunoda, Street 6-8-110, Yamazaki-Danchi 2130, Yamazaki-cho, Machida Tokyo (JP); Takaaki Tamura, 5-37-3-405 Matsumoto-cho Kanagawa-ku, Yokohama Kanagawa (JP)

( * ) Notice: Subject to any disclaimer, the term of this patent is extended or adjusted under 35 U.S.C. 154(b) by 0 days.

(21) Appl. No.: 09/663,447

(22) Filed: Sep. 15, 2000

(30) Foreign Application Priority Data

Jan. 17, 2000 (JP) ..... 12-010288

(51) Int. Cl.[7] ..... C25D 3/60

(52) U.S. Cl. ..... 205/254; 106/1.05

(58) Field of Search ..... 205/254; 106/1.05

(56) References Cited

PUBLICATIONS

Jura Ota, et al., "Plating of Indium–Tin Alloy," *Metal Surface Finishing* (Japanese), vol. 16, No. 6, pp. 246–250 (1965) No month provided.

Hisako Suzuki, "The Plating of Indium–Tin Alloy," *Metal Surface Finishing* (Japanese), vol. 15, No. 8, pp. 283–288 (1964) No month provided.

*Primary Examiner*—Kathryn Gorgos
*Assistant Examiner*—Thomas H Parsons
(74) *Attorney, Agent, or Firm*—Carmody & Torrance LLP

(57) ABSTRACT

A tin/indium alloy plating solution not containing any cyanide and serving as a substitute for tin/lead alloy plating is provided. The tin/indium alloy plating solution is a weakly alkaline aqueous solution for tin/indium alloy electroplating, prepared by adding, as metal salts, a tetravalent tin salt of metastannic acid and a trivalent indium salt of an organosulfonic acid, further adding a chelating agent, and adjusting the pH of the aqueous solution to a value of 7 to 11 with a caustic alkali.

10 Claims, No Drawings

TIN-INDIUM ALLOY ELECTROPLATING SOLUTION

BACKGROUND OF THE INVENTION

1. Field of the Invention

The present invention relates to a tin/indium alloy electroplating solution.

2. Description of the Related Art

The pollution of soil and subterranean water has recently become an issue, which pollution is caused by acid-rain elution of lead from tin/lead alloy used in waste home electronic and electric appliances. This is because tin/lead alloy is widely used in mounting electronic components. Therefore, the development of a mounting solder alloy or solder plating not containing lead is keenly desired. As a plating method not giving rise to such a problem, tin/indium alloy plating is now considered promising. The tin/indium alloy plating has heretofore been adopted as a low-melting plating, and in many of the conventional tin/indium alloy plating methods the indium content is 40 to 60 wt %. For example, in "Metal Surface Finishing (in Japanese)" Vol. 16, No. 6, pp. 246–250 (1965) there is disclosed an "Indium-tin alloy plating" solution as an indium alloy plating solution, in which the indium content is 50 wt % or so and sodium potassium tartrate is used as a chelating agent.

Also in "Metal Surface Finishing (in Japanese)" Vol. 15, No. 8, pp. 283–288 (1964) there is disclosed "Indium-tin alloy plating," in which, however, a cyanide and an alkali cyanide are used as essential components.

It is a principal object of the present invention to provide a cyanide-free tin/indium alloy electroplating solution capable of forming a tin/indium alloy plating film superior in smoothness in a wide electric current density range a n d capable of being put to practical use industrially.

SUMMARY OF THE INVENTION

Having made earnest studies, the present inventors found out that the following plating solution containing no cyanide could afford a uniform electroplated film in a wide electric current density range. On the basis of this finding we accomplished the present invention.

The present invention resides in a cyanide-free tin/indium alloy electroplating solution which comprises an aqueous solution containing a tetravalent tin salt of metastannic acid, a trivalent indium salt of an organosulfonic acid, a chelating agent, and caustic alkali and having a pH value of 7 to 11.

The present invention, in a preferred embodiment thereof, resides in the above tin/indium alloy electroplating solution wherein the chelating agent is at least one member selected from lithium, sodium and potassium salts of citric acid, tartaric acid, gluconic acid, heptonic acid, malic acid, and ascorbic acid, and the total concentration thereof is in the range of 20 to 500 g/L.

The present invention, in a further preferred embodiment thereof, resides in the above tin/indium alloy electroplating solution wherein the caustic alkali, which is used as a pH adjustor, is at least one member selected from lithium hydroxide, sodium hydroxide, and potassium hydroxide, and the total concentration thereof is in the range of 8 to 400 g/L.

The present invention, in a still further preferred embodiment thereof, resides in the above tin/indium alloy plating solution, which contains 0~300 g/L of an organosulfonic acid as an electrically conductive salt forming agent.

DETAILED DESCRIPTION OF THE INVENTION

The tin/indium alloy electroplating solution of the present invention will be described in detail hereinunder.

The metal salts used as the first essential component in the plating solution of the invention are a tetravalent tin salt of metastannic acid, such as lithium, sodium or potassium metastannic (IV) acid, and a trivalent indium salt of an organosulfonic acid, such as lithium, sodium or potassium salt of the trivalent indium. As the organosulfonic acid, an alkanesulfonic acid is preferred, examples of which include methanesulfonic acid, ethanesulfonic acid, propanesulfonic acid, 2-propanesulfonic acid, butanesulfonic acid, 2-butanesulfonic acid, pentanesulfonic acid, hexanesulfonic acid, and decanesulfonic acid. One or more of these organosulfonic acids may be the trivalent indium salt and the electrically conductive salt forming agent both used in the present invention.

As the chelating agent, which is the second essential component in the plating solution of the present invention, there is used one or more selected from lithium, sodium and potassium salts of citric acid, tartaric acid, gluconic acid, heptonic acid, malic acid, and ascorbic acid.

The chelating agent forms a chelate bond with tin and indium for a preferential deposition of tin and indium and for preventing a deposition obstructing phenomenon and functions to cause tin and indium to be deposited at a desired deposition ratio. The concentration of the chelating agent in the plating solution is 20 to 500 g/L.

The caustic alkali used as the third essential component in the plating solution of the present invention is lithium, sodium or potassium hydroxide. At least one such caustic alkali is added into the plating solution at a concentration of 8 to 400 g/L, preferably 50 to 150 g/L. The caustic alkali is added as a pH adjustor. It is necessary to adjust the pH value of the plating solution to a value of 7 to 11, preferably 8 to 10.

As plating work conditions using the tin/indium alloy electroplating solution of the invention, an appropriate electric current density is in the range of 0.1 to 30 A/dm$^2$ and an appropriate solution temperature is in the range of 100° to 60° C. With the use of the plating solution of the invention, it is possible to form a uniform and smooth tin/indium alloy plating film, the plating work can be done at a higher electric current density than in the use of a conventional plating solution of the same type, and thus the working efficiency is improved, one reason for which is that the plating solution does not contain any cyanide.

According to the cyanide-free tin/indium alloy electroplating solution of the invention, a uniform tin/indium alloy plating film superior in both smoothness and macrothrowing power can be formed in a wide electric current density range. Thus, the tin/indium alloy electroplating solution of the invention is suitable for industrial application.

EXAMPLES

The present invention will be described below in more detail by way of working examples, but it is to be understood that the invention is not limited thereto. Plating appearance in each of the following examples was evaluated by the Hull cell test.

Example 1 & Comparative Example 1

There was prepared a plating solution (pH 9) containing 27 g/L of potassium metastannate (as $Sn^{4+}$), 3 g/L of indium methanesulfonate (as $In^{3+}$), 100 g/L of methanesulfonic acid, 150 g/L of gluconic acid, and 100 g/L of potassium hydroxide as a pH adjustor. Using this plating solution, plating was carried out at an electric current of 2 A for 5 minutes, and the appearance of the resultant plating film was evaluated in a comparative manner. By way of comparison there was prepared a plating solution using indium sulfate instead of indium methanesulfonate and using Rochelle salt as a chelating agent, without using methanesulfonic acid as an electrically conductive salt forming agent. Then, using this comparative plating solution, Hull cell test was conducted under the same conditions as above. The results of the evaluation based on the Hull cell test are shown in Table 1. Examples 2~12 and Comparative Example 2

Plating solutions each comprising an aqueous solution and any of various chelating agents were prepared, the aqueous solution containing potassium or sodium metastannate (tetravalent tin salt) and trivalent indium salt of methanesulfonic acid as in Example 1. The plating solutions were then subjected to Hull cell test at an electric current of 2 A for 5 minutes. By way of comparison there was prepared a plating solution using sodium citrate instead of Rochelle salt used in Comparative Example 1. Then, using this comparative plating solution, Hull cell test was conducted under the same conditions as above. The results of evaluation based on Hull cell test are shown in Table 1.

TABLE 1

| | Example | | | | | | | | | | | | Comparative Example | |
|---|---|---|---|---|---|---|---|---|---|---|---|---|---|---|
| Component (g/L) | 1 | 2 | 3 | 4 | 5 | 6 | 7 | 8 | 9 | 10 | 11 | 12 | 1 | 2 |
| Potassium metastannate (as $Sn^{4+}$) | 27 | 27 | 27 | — | — | — | 27 | 27 | 27 | — | — | — | 27 | — |
| Sodium metastannate (as $Sn^{4+}$) | — | — | — | 27 | 27 | 27 | — | — | — | 27 | 27 | 27 | — | 27 |
| Indium methanesulfonate (as $In^{3+}$) | 3 | 3 | 3 | 3 | 3 | 3 | 6 | 6 | 6 | 6 | 6 | 6 | — | — |
| Indium sulfate (as $In^{3+}$) | — | — | — | — | — | — | — | — | — | — | — | — | 3 | 3 |
| Methanesulfonic acid | 100 | 100 | 100 | 100 | 100 | 100 | 100 | 100 | 100 | 100 | 100 | 100 | — | — |
| Gluconic acid | 150 | — | — | 150 | — | — | 150 | — | — | 150 | — | — | — | — |
| Heptonic acid | — | 150 | — | — | 150 | — | — | 150 | — | — | 150 | — | — | — |
| Ascorbic acid | — | — | 150 | — | — | 150 | — | — | 150 | — | — | 150 | — | — |
| Rochelle salt | — | — | — | — | — | — | — | — | — | — | — | — | 300 | — |
| Sodium citrate | — | — | — | — | — | — | — | — | — | — | — | — | — | 300 |
| KOH | 100 | 100 | 100 | — | — | — | 100 | 100 | 100 | — | — | — | — | — |
| NaOH | — | — | — | 70 | 70 | 70 | — | — | — | 70 | 70 | 70 | — | — |
| Hull cell appearance | | | | | | | | | | | | | | |
| High current portion | ○ | Δ | ○ | ○ | ○ | ○ | ○ | Δ | ○ | ○ | ○ | ○ | X | X |
| Medium current portion | ○ | ○ | ○ | ○ | ○ | ○ | ○ | ○ | ○ | ○ | ○ | ○ | X | X |
| Low current portion | ○ | ○ | ○ | ○ | Δ | Δ | ○ | ○ | ○ | ○ | Δ | Δ | X | X |

Hull cell appearance
○: uniform and smooth
Δ: uniform and coarse
X: non—uniform and coarse According to the present invention, as is apparent from the above results, there were obtained tin/indium alloy plating films having a uniform and smooth appearance over an area from high to low electric current portion. In contrast therewith, the comparative tin/indium alloy plating films were non-uniform and of coarse particles, reflecting a suppressed co-deposition of indium. Further, a passive-state film was formed on the anode side.

What is claimed is:

1. A process for electrolytically plating a tin/indium alloy upon a substrate, said process comprising:

a. contacting the substrate with a plating solution comprising:

(i) tetravalent tin salt of metastannic acid;

(ii) trivalent indium salt of an organosulfonic acid;

(iii) chelating agent; and (iv) a source of alkalinity; and b. applying an electrical potential to the substrate thereby causing it to become a cathode and causing a tin/indium alloy to plate upon said substrate;

wherein the plating solution is substantially cyanide free and has a pH in the range of from 7 to 11.

2. A process according to claim 1, wherein said chelating agent is selected from the group consisting of lithium, sodium or potassium salts of citric acid, tartaric acid, gluconic acid, heptonic acid, malic acid, ascorbic acid, and mixtures thereof and wherein the total concentration of the chelating agent in the plating solution is from 20 to 500 g/l.

3. A process according to claim 2, additionally comprising an organosulfonic acid.

4. A process according to claim 1, wherein the source of alkalinity is selected from the group consisting of lithium hydroxide, sodium hydroxide, and potassium hydroxide and wherein the total concentration of the source of alkalinity in the plating solution is from 8 to 400 g/l.

5. A process according to claim 4, additionally comprising an organosulfonic acid.

6. A process according to claim 1, additionally comprising an organosulfonic acid.

7. A tin/indium alloy electroplating solution comprising:

a. tetravalent tin salt of metastannic acid;

b. trivalent indium salt of an organosulfonic acid;

c. chelating agent; and d. a source of alkalinity;

wherein the pH of the electroplating solution is from 7 to 11 and wherein the electroplating solution is substantially free of cyanide.

8. An electroplating solution according to claim 7, wherein said chelating agent is selected from the group consisting of lithium, sodium or potassium salts of citric acid, tartaric acid, gluconic acid, heptonic acid, malic acid, ascorbic acid, and mixtures thereof and wherein the total concentration of the chelating agent in the plating solution is from 20 to 500 g/l.

9. An electroplating solution according to claim 7, wherein the source of alkalinity is selected from the group consisting of lithium hydroxide, sodium hydroxide, and potassium hydroxide and wherein the total concentration of the source of alkalinity in the plating solution is from 8 to 400 g/l.

10. An electroplating solution according to claim 7 additionally comprising an organosulfonic acid.

* * * * *